US006593846B1

(12) United States Patent
Watts

(10) Patent No.: US 6,593,846 B1
(45) Date of Patent: Jul. 15, 2003

(54) SPORTING GAME TIME-OUT INDICATOR

(75) Inventor: Bruce D. Watts, Greens Fork, IN (US)

(73) Assignee: Connie Watts, Greens Fork, IN (US)

( * ) Notice: Subject to any disclaimer, the term of this patent is extended or adjusted under 35 U.S.C. 154(b) by 0 days.

(21) Appl. No.: 09/949,961

(22) Filed: Sep. 10, 2001

(51) Int. Cl.[7] ..... G08B 5/36; A63F 13/00
(52) U.S. Cl. ..... 340/323 R; 700/91
(58) Field of Search ..... 463/1, 30; 700/91, 700/92; 340/323 R; 473/472

(56) References Cited

U.S. PATENT DOCUMENTS 3,302,192 A * 1/1967 Laughlin
3,399,400 A * 8/1968 Lucka
3,638,215 A * 1/1972 Payne
3,868,671 A * 2/1975 Maguire et al.
3,981,002 A * 9/1976 Gardner
4,045,788 A * 8/1977 Castelli et al.
4,266,214 A * 5/1981 Peters, Jr.
4,751,506 A * 6/1988 Brown
5,181,009 A * 1/1993 Perona
5,818,327 A * 10/1998 Berg
5,894,261 A * 4/1999 Green
6,012,995 A * 1/2000 Martin
6,148,242 A * 11/2000 Descalzi et al.

* cited by examiner

*Primary Examiner*—Michael O'Neill
(74) *Attorney, Agent, or Firm*—Clifford W. Browning; Woodard, Emhardt, Moriarty, McNett & Henry LLP

(57) ABSTRACT

In a preferred embodiment of the present invention, a box is provided for placement upon the official scorekeeper's table which includes a plurality of lights on a surface thereof. By actuating corresponding switches on the exterior of the box, the official scorekeeper is able to illuminate lights (or conversely to extinguish lights) in order to indicate how many time outs have been used by each team. In the preferred embodiment, the time-out indicator lights are integrated into the same box which is used to display the possession arrow for each team.

15 Claims, 3 Drawing Sheets

SPORTING GAME TIME-OUT INDICATOR

TECHNICAL FIELD OF THE INVENTION

Present invention generally relates to electrical devices and, more particularly, a sporting game time-out indicator.

BACKGROUND OF THE INVENTION

In many sports, such as basketball but also many other sports, there is an official scorekeeper who keeps track of the score of the game, as well as other relevant statistics, in an official score book. In the case of basketball, the scorekeeper also keeps track of which team has possession of the ball, and a written record of this is kept in the official score book as the game progresses. In addition, there is typically a possession arrow indicator kept on the scorekeeper's table, such as the possession arrow indicator box 10 illustrated in FIG. 1. The possession indicator box 10 is typically a simple metal box which contains two light bulbs which can alternately be lit or extinguished depending upon the position of a switch (not shown) located on the back of the box 10. The front of the box includes two possession arrow cutouts 12 through which a respective light bulb within the box may shine. By placing the possession switch in a first position, one of the arrows 12 is illuminated and the other is extinguished. By placing the switch in a second position, the arrow that is currently illuminated is extinguished and the arrow that is currently extinguished is illuminated. By use of the possession arrow indicator box 10, the scorekeeper is not only able to keep a redundant notation of which team has possession of the ball, but the players, coaches, referees and fans are also able to easily determine which team currently has possession of the ball.

In basketball, the official scorekeeper also keeps track of how many of the allotted time outs have been used by each team. Typically, each team is allotted three 60-second time-outs and two 30-second time-outs per game. If the game extends into overtime, two additional overtime time-outs are allotted to each team. Keeping track of which of these time-outs have been used by each team is obviously a much more complicated task than keeping track of which team has possession of the ball. The scorekeeper duly notes in the official score book as time-outs are used by a team. Referees, coaches, players and fans all would like to know how many time-outs each team has used at various points during the game. For example, in order for a coach to adequately plot a strategy for the game, it is often of necessity that he know how many time-outs he has already used so that he can determine the possible scenarios in which he may be able to utilize time-outs from this point toward the end of the game.

Referees also need to know how many time-outs have been used by each team so that they may accurately determine whether a team is entitled to take a time-out if one is so indicated by that team. Additionally, particularly toward the end of the game, a player who is falling out of bounds (which would transfer possession of the ball to the other team if the player steps out of bounds), will often call time-out before contacting the floor in order to prevent possession from transferring to the other team. If the player attempts to do this and the team has no time-outs available, then this team receives a technical foul and the opposing team is permitted to shoot two free-throws and receive possession of the ball. If a player calls for a time-out when none are remaining, such a situation can result in loss of the game. Even in such "non-emergency" situations, coaches, players and referees are constantly inquiring of the scorekeeper how many time-outs have been used by each team. Such general confusion delays the progress of the game, places excessive burdens on the scorekeeper, greatly increases the likelihood of coaches, players and/or referees making mistakes during the course of the game related to incorrect knowledge as to how many time-outs have been used by each team.

There is therefore a need for a system which would allow the time-out information kept by the official scorekeeper to be more easily transferred to referees, coaches, players and/or fans. The present invention is directed toward meeting this need.

SUMMARY OF THE INVENTION

In a preferred embodiment of the present invention, a box is provided for placement upon the official scorekeeper's table which includes a plurality of lights on a surface thereof. By actuating corresponding switches on the exterior of the box, the official scorekeeper is able to illuminate lights (or conversely to extinguish lights) in order to indicate how many time outs have been used by each team. In the preferred embodiment, the time-out indicator lights are integrated into the same box which is used to display the possession arrow for each team.

DETAILED DESCRIPTION OF THE PREFERRED EMBODIMENTS

Figure 1:
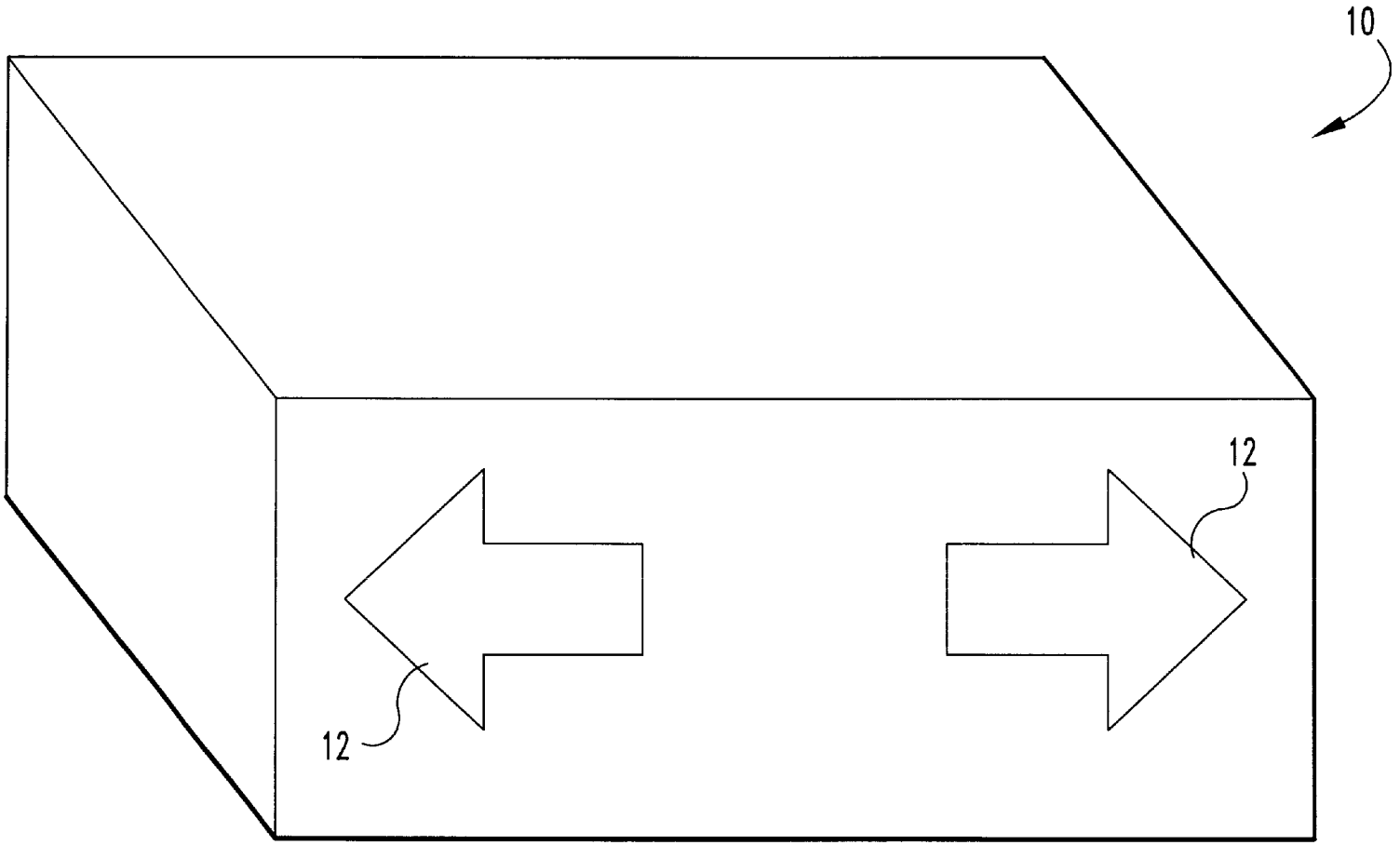
Fig. 1 (Prior Art)
FIG. 1 is a perspective view of a prior art possession arrow indicator box.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
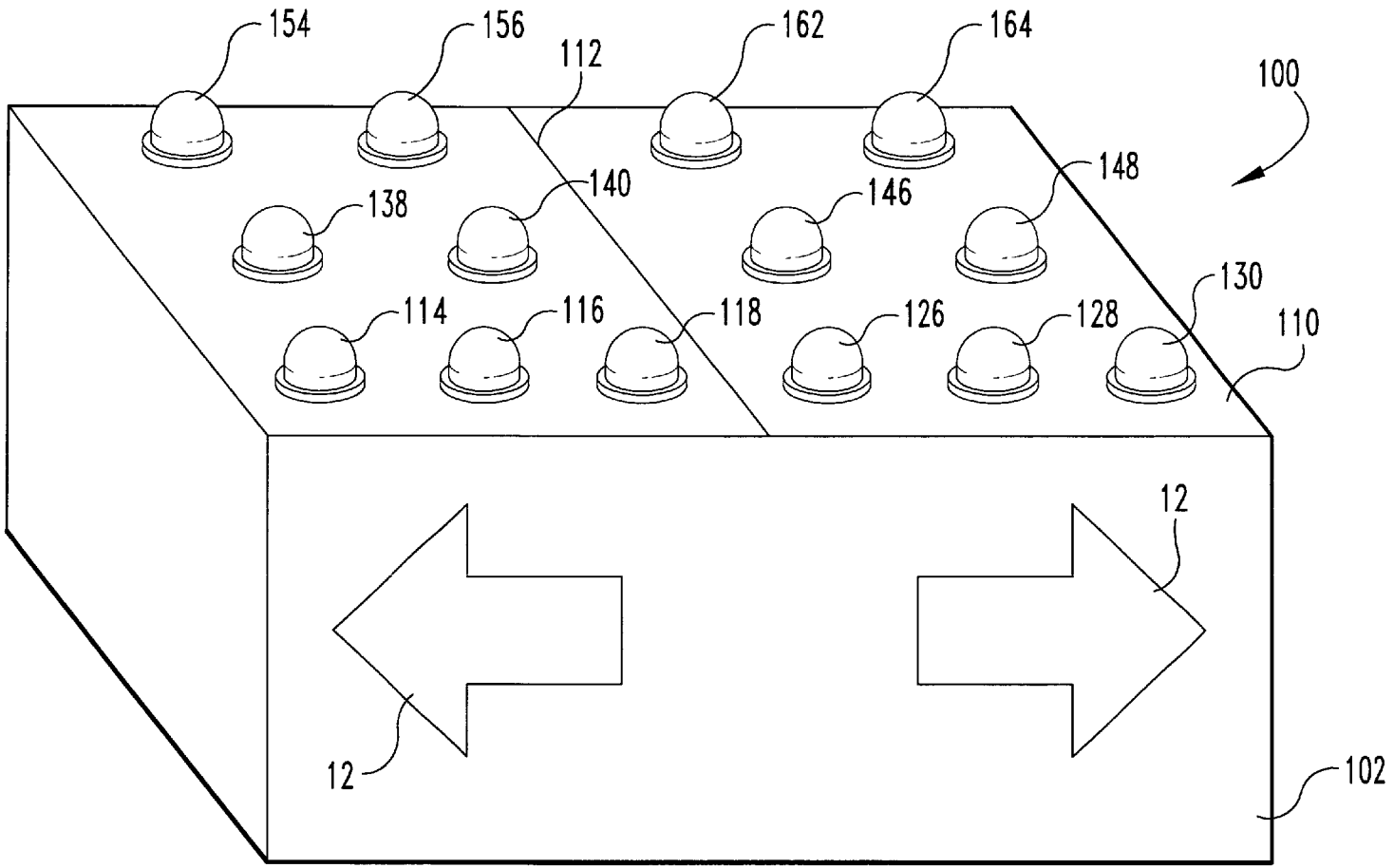
FIG. 2 is a first perspective view of a preferred embodiment sporting game time-out indicator box of the present invention.
Figure 3:
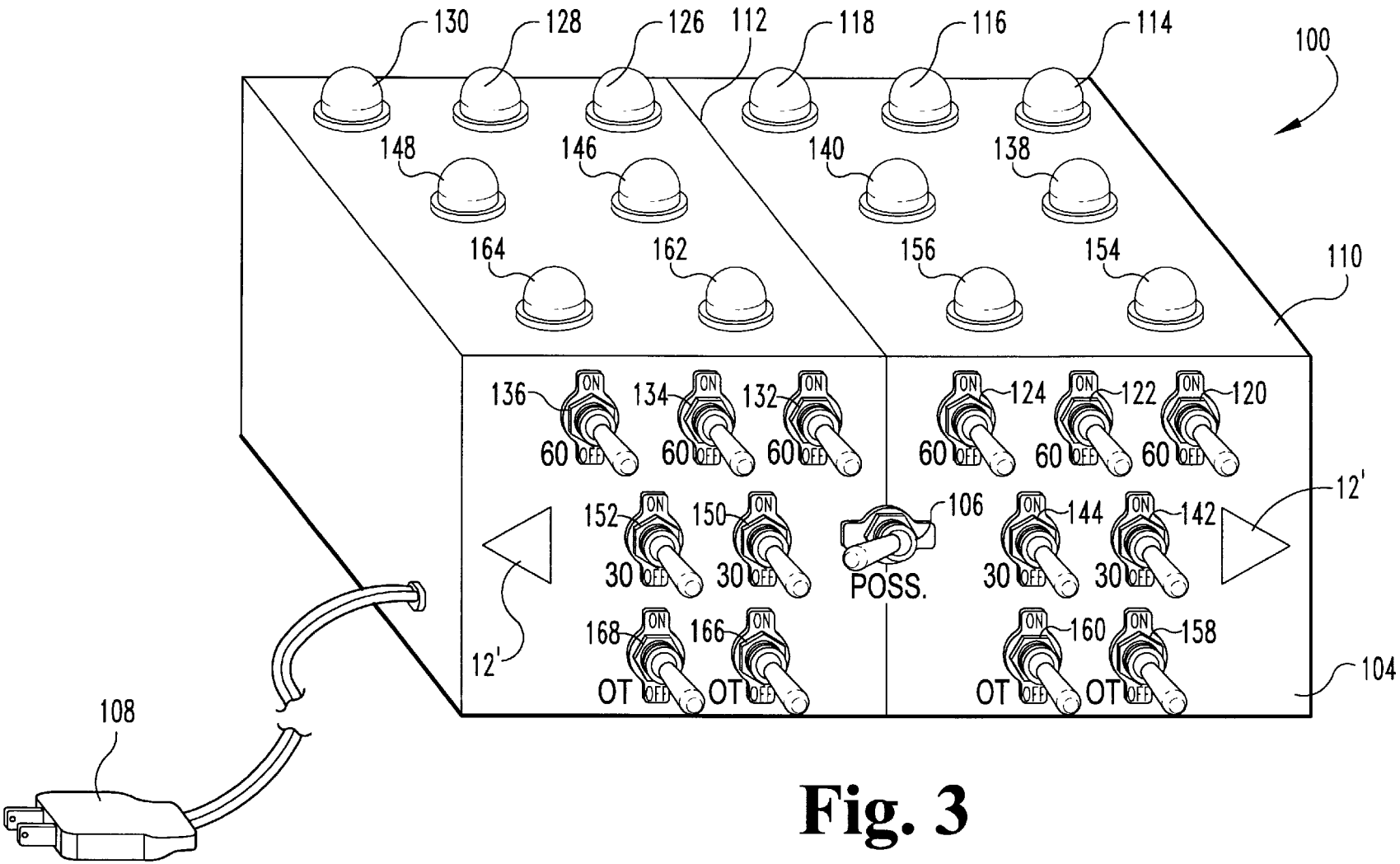
FIG. 3 is a second perspective view of a preferred embodiment sporting game time-out indicator box of the present invention.

A preferred embodiment time-out indicator light of the present invention is illustrated in FIGS. 2 and 3, and indicated generally at 100. In the preferred embodiment, the time-out indicator 100 is housed in a rectangular metal box; however, those having ordinary skill in the art will appreciate that the time-out indicator 100 may be housed in any suitable enclosure which is adapted to sit upon the official scorekeeper's table and to provide adequate display visibility to coaches, players, referees and fans.

As with the possession arrow indicator 10 of the prior art, the time-out indicator 100 includes possession arrows 12 which may be illuminated in order to provide a visible indication as to which team currently has possession of the ball. The arrows 12 are preferably situated upon the front panel 102 of the time-out indicator 100. The rear panel 104 of the time-out indicator 100 preferably includes arrows 12' which are also illuminated when the respective arrow 12 on the same side of the box is illuminated. Provision of the arrows 12' allow the official scorekeeper to verify that the correct arrow 12 is illuminated, and allows fans sitting behind the scorekeeper to see which team has possession. For example, if the light within the box 100 were to burn out, the official scorekeeper would be immediately informed of this situation by the non-illumination of the arrow 12' which is visible to the official scorekeeper. Which arrow 12/12' is illuminated is controlled by a possession switch 106 mounted on the back panel 104. Although toggle switches are illustrated herein for the possession switch 106 and the other switches discussed below, it will be appreciated by those having ordinary skill in the art that any switching device may be utilized in place of the toggle switches. It will further be appreciated by those having ordinary skill in the art that electrical power supplied by an electrical cord 108 (or by an internal battery or by other convenient means) may be switched by any of the switches mentioned herein to the corresponding indicator light. Such electrical wiring is rudimentary and in the possession of those having even modest knowledge of electronics and is therefore not specifically illustrated herein. Furthermore, it is not necessary that the possession arrows 12/12' be illuminated by means of a light bulb within the indicator box. For example, arrows 12/12' could be made from devices, such as an active matrix TFT device or plasma device, which illuminate when power is applied to them.

The time-out indicator box 100 therefore preferably contains the possession arrow indicating function of the prior art box 10 illustrated in FIG. 1, however this is not necessary. The present invention also comprehends a time-out indicator in which the time-out indication function is separate from the possession arrow indication function. However, it is felt that incorporating both functions into a single box is preferred in order to minimize space taken up on the official scorekeeper's table.

The time-out indicator 100 further includes a top surface 110 which is roughly divided into two equal quadrants by the line 112. It should be appreciated that the line 112 is included for illustration purposes; however, it is not necessary that an actual line 112 be present on the top surface 110. In order to indicate the three 60-second time-outs available to each team, indicator lights 114, 116 and 118 are provided on a first side of the box 100 and are operated by respective toggle switches 120, 122 and 124. Placing a toggle switch 120–124 in a first position will illuminate the respective indicator light 114–118, while placing the toggle switch in the second position will extinguish the respective indicator light. Similarly, 60-second time-out indicator lights 126, 128 and 130 are provided on the other side of the time-out indicator box 100 and are controlled by respective switches 132, 134 and 136. In a preferred embodiment, the 60-second time-out indicator lights 114–118 and 126–130 are colored red in order to more readily distinguish the fact that these lights indicate 60-second time-outs. As indicated in greater detail hereinbelow, the remaining time-out indicator lights on box 100 are color-coded with different colors in order to indicate other types of time-outs.

Because each team receives only two 30-second time-outs, indicator box 100 includes indicator lights 138 and 140 controlled by respective switches 142 and 144. Similarly, the other side of indicator box 100 includes 30-second time-out indicator lights 146 and 148 controlled by respective switches 150 and 152. In order to more readily distinguish the 30-second time-out indicator lights 138, 140, 146 and 148 from the other indicator lights of box 100, these 30-second time-out indicator lights are preferably colored white.

Each team is also given two overtime time-outs, therefore the box 100 preferably includes overtime time-out indicator lights 154 and 156 on one side thereof respectively controlled by switches 158 and 160. Similarly, the other side of time-out indicator light box 100 preferably includes overtime time-out indicator lights 162 and 164 respectively controlled by switches 166 and 168. In order to more readily distinguish the overtime time-out indicator lights 154, 156, 162 and 164 from the other indicator lights of box 100, these overtime time-out indicator lights are preferably colored blue. Additionally, the overtime time-out indicator lights 154, 156, 162 and 164 may optionally be deleted from the box 100 in order to lower its cost.

By appropriately wiring each of the switches between the source of power 108 and the respective indicator light, the switches on the back panel 104 of the time-out indicator box 100 may be used to conveniently control illumination of the respective time-out indicator lights. Because there is a time-out indicator light corresponding to each of the time-outs available to each team, the time-out indicator light box 100 may be operated in two different modes. In the first mode, all of the indicator lights may be extinguished at the beginning of the game and then illuminated as time-outs are used by the respective team. In this mode of operation, illuminated lights indicate time-outs that have been used and extinguished lights indicate time-outs remaining. In a second mode of operation, all of the indicator lights may be illuminated at the start of the game, and then extinguished as time-outs are used by the respective team. In the second mode of operation, illuminated lights indicate time-outs remaining, while extinguished lights indicate time-outs that have been used. Either mode of operation may be utilized as long as all of the referees, coaches, players and/or fans are aware of the system in use.

It will be appreciated that provision of the time-out indicator of the present invention to the official scorekeeper will provide a convenient and greatly improved means of communicating the official time-out record to referees, coaches, players and/or fans. With the box 100 of the present invention located directly in front of or adjacent to the official scorekeeper, it is relatively easy for the time-out indicator lights to be illuminated or extinguished as official notation is made in the official score book. By providing the indicator lights which are readily visible to all parties, the need to consult with the official scorekeeper as to the number of time-outs used by any particular team is eliminated, thereby increasing the pace of the game, eliminating errors on the part of referees, coaches and/or players and minimizing the numbers of inquiries made to the official scorekeeper during the course of the game.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A sporting game time-out indicator, comprising:

an enclosure having a front surface, a top surface and a back surface;

first and second illuminatable possession arrows disposed on the front surface;

a possession switch disposed on the back surface, the possession switch having a first possession switch position operable to illuminate the first possession arrow and a second possession switch position operable to illuminate the second possession arrow;

first, second, third, fourth, fifth and sixth illuminatable 60-second time-out indicators disposed on the top surface;

first, second, third, fourth, fifth and sixth 60-second time-out switches disposed on the back surface and respectively coupled to the first, second, third, fourth, fifth and sixth 60-second time-out indicators, said first, second, third, fourth, fifth and sixth 60-second time-out switches operable to selectively illuminate and extinguish said respective first, second, third fourth, fifth and sixth 60-second time-out indicators;

first, second, third and fourth illuminatable 30-second time-out indicators disposed on the top surface;

first, second, third and fourth 30-second time-out switches disposed on the back surface and respectively coupled to the first, second, third and fourth 30-second time-out indicators, said first, second, third and fourth 30-second time-out switches operable to selectively illuminate and extinguish said respective first, second, third and fourth 30-second time-out indicators;

first second, third and fourth illuminatable overtime time-out indicators disposed on the top surface; and first, second, third and fourth overtime time-out switches disposed on the back surface and respectively coupled to the first, second, third and fourth overtime time-out indicators, said first, second, third and fourth overtime time-out switches operable to selectively illuminate and extinguish said respective first, second, third and fourth overtime time-out indicators.

2. The sporting game time-out indicator of claim 1, wherein said enclosure comprises a box.

3. The sporting game time-out indicator of claim 1, wherein said first and second illuminatable possession arrows each comprise:

a cut-out through the enclosure; and a light bulb disposed in the enclosure proximate the cut-out;

wherein illumination of the light bulb causes light to shine through the cut-out.

4. The sporting game time-out indicator of claim 1, wherein said first, second, third, fourth, fifth and sixth 60-second time-out indicators, said first, second, third and fourth 30-second time-out indicators and said first, second, third and fourth overtime time-out indicators each comprise a light bulb.

5. The sporting game time-out indicator of claim 1, wherein said possession switch, said first, second, third, fourth, fifth and sixth 60-second time-out switches, said first, second, third and fourth 30-second time-out switches and said first, second, third and fourth overtime time-out switches each comprise a toggle switch.

6. A sporting game time-out indicator, comprising:

an enclosure having a front surface, a top surface and a back surface;

first and second illuminatable possession arrows disposed on the front surface;

a possession switch disposed on the back surface, the possession switch having a first possession switch position operable to illuminate the first possession arrow and a second possession switch position operable to illuminate the second possession arrow;

a plurality of illuminatable 60-second time-out indicators disposed on the top surface;

a plurality of 60-second time-out switches disposed on the back surface and respectively coupled to the plurality of 60-second time-out indicators, said plurality of 60-second time-out switches operable to selectively illuminate and extinguish said respective plurality of 60-second time-out indicators;

a plurality of illuminatable 30-second time-out indicators disposed on the top surface;

a plurality of 30-second time-out switches disposed on the back surface and respectively coupled to the plurality of 30-second time-out indicators, said plurality of 30-second time-out switches operable to selectively illuminate and extinguish said respective plurality of 30-second time-out indicators;

a plurality of illuminatable overtime time-out indicators disposed on the top surface; and a plurality of overtime time-out switches disposed on the back surface and respectively coupled to the plurality of overtime time-out indicators, said plurality of overtime time-out switches operable to selectively illuminate and extinguish said respective plurality of overtime time-out indicators.

7. The sporting game time-out indicator of claim 6, wherein said enclosure comprises a box.

8. The sporting game time-out indicator of claim 6, wherein said first and second illuminatable possession arrows each comprise:

a cut-out through the enclosure; and a light bulb disposed in the enclosure proximate the cut-out;

wherein illumination of the light bulb causes light to shine through the cut-out.

9. The sporting game time-out indicator of claim 6, wherein said plurality of 60-second time-out indicators, said plurality of 30-second time-out indicators and said plurality of overtime time-out indicators each comprise a light bulb.

10. The sporting game time-out indicator of claim 6, wherein said possession switch, said plurality of 60-second time-out switches, said plurality of 30-second time-out switches and said plurality of overtime time-out switches each comprise a toggle switch.

11. A sporting game time-out indicator, comprising:

an enclosure;

first and second illuminatable possession arrows disposed on the enclosure;

a possession switch disposed on the enclosure, the possession switch having a first possession switch position operable to illuminate the first possession arrow and a second possession switch position operable to illuminate the second possession arrow;

at least one illuminatable 60-second time-out indicator disposed on the enclosure;

at least one 60-second time-out switch disposed on the enclosure and respectively coupled to the at least one 60-second time-out indicator, said at least one 60-second time-out switch operable to selectively illuminate and extinguish said respective at least one 60-second time-out indicator;

at least one illuminatable 30-second time-out indicator disposed on the enclosure;

at least one 30-second time-out switch disposed on the enclosure and respectively coupled to the at least one 30-second time-out indicator, said at least one 30-second time-out switch operable to selectively illuminate and extinguish said respective at least one 30-second time-out indicator;

at least one illuminatable overtime time-out indicator disposed on the enclosure; and at least one overtime time-out switch disposed on the enclosure and respectively coupled to the at least one overtime time-out indicator, said at least one overtime time-out switch operable to selectively illuminate and extinguish said respective at least one overtime time-out indicator.

12. The sporting game time-out indicator of claim 11, wherein said enclosure comprises a box.

13. The sporting game time-out indicator of claim 11, wherein said first and second illuminatable possession arrows each comprise:

a cut-out through the enclosure; and a light bulb disposed in the enclosure proximate the cut-out;

wherein illumination of the light bulb causes light to shine through the cut-out.

14. The sporting game time-out indicator of claim 11, wherein said at least one 60-second time-out indicator, said at least one 30-second time-out indicator and said overtime time-out indicator each comprise a light bulb.

15. The sporting game time-out indicator of claim 11, wherein said possession switch, said at least one 60-second time-out switch, said at least one 30-second time-out switch and said at least one overtime time-out switch each comprise a toggle switch.

* * * * *